US007913436B2

(12) United States Patent
Li

(10) Patent No.: US 7,913,436 B2
(45) Date of Patent: Mar. 29, 2011

(54) OMNIBEARING DISPLAY SYSTEM OF INTEGRATED DISPLAY SCREENS

(76) Inventor: Weiqing Li, Shandong (CN)

( * ) Notice: Subject to any disclaimer, the term of this patent is extended or adjusted under 35 U.S.C. 154(b) by 383 days.

(21) Appl. No.: 11/989,377

(22) PCT Filed: Jul. 25, 2005

(86) PCT No.: PCT/CN2005/001113

§ 371 (c)(1),
(2), (4) Date: Jan. 25, 2008

(87) PCT Pub. No.: WO2007/012218

PCT Pub. Date: Feb. 1, 2007

(65) Prior Publication Data

US 2009/0260266 A1 Oct. 22, 2009

(51) Int. Cl.
*G09F 11/02* (2006.01)

(52) U.S. Cl. ..... 40/493; 40/473; 40/429

(58) Field of Classification Search ..... 40/493, 40/470–473

See application file for complete search history.

(56) References Cited

U.S. PATENT DOCUMENTS

| | | | | | |
|---|---|---|---|---|---|
| 2,075,245 | A * | 3/1937 | Van Schuck | 40/473 |
| 3,135,063 | A * | 6/1964 | Ricks | 40/473 |
| 4,195,910 | A * | 4/1980 | Imes, Jr. | 359/626 |
| 4,641,442 | A * | 2/1987 | Filmer | 40/219 |
| 5,046,274 | A * | 9/1991 | David | 40/604 |
| 6,148,552 | A * | 11/2000 | Dumontier et al. | 40/473 |
| 7,000,343 | B1 * | 2/2006 | Teichman | 40/436 |

* cited by examiner

*Primary Examiner* — Joanne Silbermann
*Assistant Examiner* — Shin Kim
(74) *Attorney, Agent, or Firm* — Nixon & Vanderhye P.C.

(57) ABSTRACT

An omni-directional display technology allows for obtaining better display effect and more rational dynamical structure through adopting the assembly of two or more rotating and symmetrical configurable structure of display which is fitted with a blankoff device, comprising: one chassis (12), one rotating display part consisting of a display (1) which is fitted with a blankoff device (3) in front of the display plane, and one vertical rotary driving device (11) fitted on the chassis. This driving device is connected to the rotating display part, comprised of two or more displays which are equipped with blankoff devices and distributed around the vertical axial line, which will, when driven by the vertical rotary driving device, rotate around a vertical axial line (L) and thus realize omni-directional display. This display system is featured by high display brightness, low rotating speed, fine integrity, rational dynamical structure, safe and reliable running, and other advantages.

20 Claims, 1 Drawing Sheet

OMNIBEARING DISPLAY SYSTEM OF INTEGRATED DISPLAY SCREENS

CROSS REFERENCE TO PRIORITY APPLICATION

This is a U.S. national phase application of PCT Application No. PCT/CN2005/001113, filed Jul. 25, 2005, incorporated herein by reference in its entirety.

BACKGROUND OF THE PRESENT INVENTION

1. Field of Invention

This invention is relate to the field of display technology. It primarily involves an optimized omni-directional display system of integrated display which is capable of providing constant omni-directional display effect through applying the effect of visual persistence.

2. Description of Related Arts

Methods and Devices for Omni-Directional Display contains current technologies and presents an invention (It has acquired Chinese and American patent right; Patent No.: ZL92108510.9 and U.S. Pat. No. 5,450,094A) of the inventor at early stage. This invention provides audience with such an unprecedented visual effect that observers at any position around the device can feel that they are squarely facing the central front part of pictures on the display. Under the effect of visual persistence of eyes, this unprecedented visual effect is obtained by making pictures on a display fitted with a blankoff device reflect on people's eyes repeatedly at imperceptible speed within the time limit of visual persistence. Blankoff device is capable of restricting observable angles, namely, making any of pixels on a display viewable to observers only when they are squarely facing the pixel. Accordingly, what an observer can view is an integral picture facing him precisely, which is comprised of all pixels precisely facing the observer. Due to the effect of blankoff device, pixels forming the same pictures are not viewed simultaneously by all observers. In contrast, they are scanned on eyes at imperceptible speed.

It is owing to the restriction of blankoff device on people's observing angles that they can see a frontal, non-overlapped and clear picture. However, its defect also lies in the restriction. When restricting observing angles, blankoff device makes restriction on observing duration, for when pixels on a display rotate for one circle, they can be viewed by observers for merely one time in a twinkle. Pixels are blanked off at most time, which results in the substantial reduction of brightness of a display. With its unique display characteristics, omni-directional display device is especially applicable to large-scale public places, e.g. large-scale expo, science & technology hall, museum, hotel, air harbor, central part of great hall in station and plaza. Since these public places are provided with comparatively bright background, they establish higher requirements for the brightness of display so that it can adapt to the environment and conform to requirements of observers. However, the existing varieties of display materials such as liquid crystal, light-emitting diode, plasma and organic luminophor are of limited brightness (especially in comparison with the omni-directional display device). Despite large-scale enterprises and research institutions specialized in this field in many countries have been making efforts to improve brightness of these materials, they haven't made considerable progress in this regard so far. More importantly, displays used in large-scale public places are required to be large-sized (e.g. its diagonal line is as long as 100 cm or above), so that they can be viewed simultaneously by different observers. Simulated tests and actual measurement of sample device performed for many times by the inventor have indicated that in order to make twinkles generated at the time of picture replacement imperceptible to observers, it is advisable to control the frequency of picture replacement at a rate of approx. 24 pieces per second. To obtain this, it is preferred that the rotary speed of rotating part fitted with only one display should be controlled at 24 circles per second. Only in this way can we achieve anticipated display effect. In case pictures are replaced at over-slow speed, observers will perceive twinkles of pictures and therefore the visual effect will be deteriorated. For instance, the rotating speed of external terminal line in a large-sized device with 1.5 m external rotating diameter will exceed 100 m/s when the rotating speed of the device is 24 circles per second. To enable the device to equally bear enormous effect of centrifugal force, it is crucial to give top priority to dynamic equilibrium of mechanism and allocation of inherent stress, which are complicated and require high cost.

SUMMARY OF THE PRESENT INVENTION

In view of the top priority given to principle demonstration in former invention of the inventor, this invention is, with the aim of eking out the former invention, primarily designed to provide an omni-directional display system of integrated display. This display system is of higher practicality and is capable of realizing omni-directional display at comparatively low rotating speed.

The present invention relates to an omni-directional display system. It consists of components as follows: one chassis, one rotating display part consisting of a display which is fitted with a blankoff device in front of the display plane (the part right ahead of the display), and one vertical rotary driving device fitted on the chassis. This driving device is connected to the rotating display part which will, when driven by the vertical rotary driving device, rotate around a vertical axial line. The rotating display part is particularly comprised of two or more displays which are equipped with blankoff devices and distributed around the vertical axial line.

In order to ensure that the picture on display is clear and free of double ghost and image fault, specification of every display should be in strict conformity with matrix distance of every pixel and other technical indexes. Also, pictures transmitted to every display by wire and wireless means shall be completely the same (this can be attained by applying mature technologies at present). By contrast, when certain special display effect is required to be obtained, corresponding adjustment shall be done on the shape and dimension of some of the displays. For instance, in order to highlight the display of certain part of the overall picture, it is advisable to make the shape and dimension of some displays conform to those of the very part needing highlighted display.

Additionally, to obtain better display effect, it is recommended to install every display to such that the display plane is perpendicular to the horizontal plane. However, in the event the quality of displayed picture is acceptable, it is also acceptable to make a display installed on a slant.

One typical technical option included in this invention is an omni-directional display system of integrated display which is comprised of four displays fitted with blankoff devices. With this system, the mechanism may rotate at a speed of six circles per second if pictures are required to appear for 24 times per second. Rotating speed of the mechanism is one fourth of that of the former invented device. In this case, every pixel on a display can be reflected on the observer's eyes with the duration being four times as long as that of the former invented device. At the same time, the brightness of display is four times as high as that of the former invented one (It is revealed by related documents that brightness of the above-mentioned display materials have been improved by less than 20% so far, despite that manufacturers and research institutions in this field have turned to tremendous capital input to improve their brightness since such materials were commercialized.). In this invention, brightness is one of the crucial indexes that are decisive to service value of this device.

As for the applicability of mechanical structure, take the above-mentioned typical technical option used in this invention for example. Both the rotating speed of mechanism and linear speed of revolver with the same diameter are reduced to one fourth of that of the former invented device. Also, the centrifugal force is in direct proportion to the square of linear speed. Therefore, centrifugal force borne on the device in this invention is one sixtieth as less as that of the former invented device. Moreover, the display (main body of the rotating part) is symmetrically collocated and distributed with the blankoff device, which enables rotating part of the system to be proportionally stressed and such stress to be enormously reduced. In the mean while, due to indistinct difference in distance between the central part of the display and the rotating center as well as distance between two sides of the display and the rotating center, both the display and blankoff device are stressed in a comparatively symmetrical way, which is of great importance to these components.

Featuring high display brightness, low rotating speed, fine integrity, rational dynamical structure and other advantages, the omni-directional display system of integrated display in this invention is substantially upgraded in the area of display effect, safety performance as well as collocation and debugging of mechanism, etc.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

Detailed descriptions are given on a favorably implemented example of this invention in combination with attached figures, for the purpose of highlighting characteristics and advantages of this invention.

DETAILED DESCRIPTION OF THE PREFERRED EMBODIMENT

Figure 1:
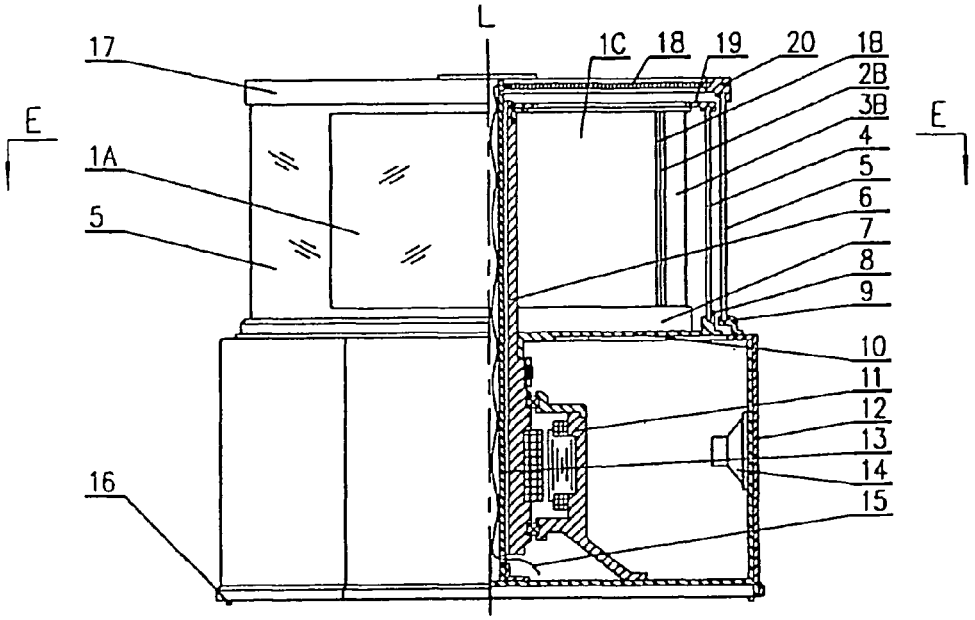
FIG. 1: Main-view schematic diagram for partial cut-away omni-directional display system of integrated display in this favorably implemented example.
Figure 2:
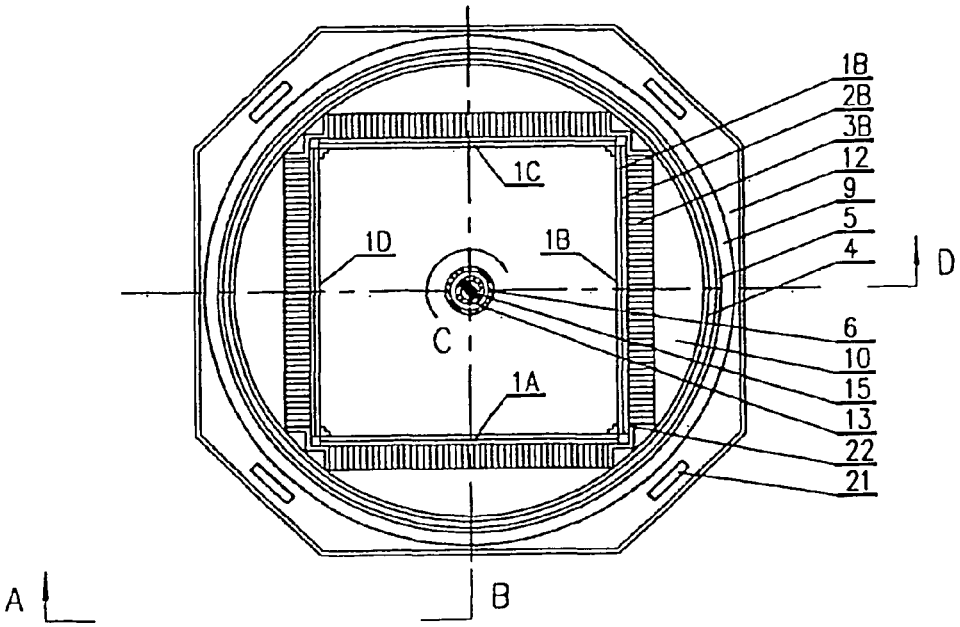
FIG. 2: Sectional-view schematic diagram for omni-directional display system of integrated display dissected along F-F line as shown in FIG. 1.

FIG. 1 presents sectional-view schematic diagram for omni-directional display system of integrated display dissected along A-B-C-D line as shown in FIG. 2. It is clearly shown in FIG. 1 that the system is divided into two major parts, with the upper part consisting of display, and the lower part being comprised of chassis and driving component. There are a total of four displays mounted in the system: 1A, 1B, 1C and 1D. All of them are equipped with display planes of the same shape and dimension. Every display is fitted with high-strength transparent guard plate 2 (including 2A, 2B, 2C and 2D; only 2B is marked in the figure) in front of the display plane. It is designed to counteract the impact of centrifugal force on the display. Such guard board is not necessary to be mounted if the display is of high strength. Blankoff device 3 (including 3A, 3B, 3C and 3D; only 3B is marked in the figure) should be mounted in front of the guard board. It consists of a number of dark-hued flakes which have undergone flat gloss treatment. Upper and lower ends of tense flakes are partitioned by spacers so that a narrow slit is formed between two flakes. Spacers are fixed to flakes with screws. It is through these narrow slits between flakes that observers can view pictures on the display.

A display unit is comprised of a display, a guard board and a blankoff device. Four similar display units are symmetrically and firmly mounted with fasteners on four sets of supporting frames 22, thus forming a square (as shown in FIG. 2), with rotor shaft 6 (see following descriptions) as the symmetrical center. What is fixed around these four display units is a transparent wind-resistant hull 4 which is of circular cylindrical surface. Upper and lower ends of four display units and the transparent wind-resistant hull 4 are respectively fixed on the upper circular rotary cover 19 and rotary base plate is 10. Rotary base plate 10 is fitted with bottom border of display 7 and lower border of wind-resistant hull 8 to ensure that the positioning of all display units and the wind-resistant hull is more precise and their structures are firmer. It is preferred to fabricate the base plate 10 and the lower border of wind-resistant hull 8 into a whole. Rotating display part consisting of the above-mentioned components constitutes an integral and relatively enclosed cylinder, which is capable of counteracting the effect of centrifugal force and reducing the impact on display units imposed by wind resistance and air current generating at the time of rotation. Upper rotary cover 19 is provided with a number of ventilating ducts (ventilating openings such as circular hole are also acceptable) which are stretching along the direction of radius of the cover. These ducts serve as heat dissipating channels for displays in the rotating display part or channels for heat dissipation and exchange between the displays and semiconductor refrigerating installations (as described in the following content).

Rotor shaft 6 of electric motor 11 is perpendicular to upper rotary cover 19 and rotary base plate 10 and is stretching from the inside of electric motor 11 to the upper plane of upper rotary cover 19. Axial lead of rotor shaft 6 and the rotary central lines of upper rotary cover 19 and rotary base plate 10 (vertically symmetrical central axis of four display units which jointly form a square) are coaxial. Such vertical axial lines are marked with "L" in figures. Rotor shaft 6 is fabricated into hollow pipe. Upper rotary cover 19, rotary base plate 10 and other components (they are not shown in figures) including windings and conducting rings of electric motor (electric power and audiovisual signals of displays are transmitted via conducting rings; conducting rings required for audiovisual signals shall be screened.) are precisely fixed on rotor shaft 6 via corresponding steps which are made in external wall surface of rotor shaft 6. Rotor shaft 6 and the central pipe riser 13 shall be of comparatively high strength and rigidity so that they can firmly support components fixed on them. To obtain such strength and rigidity, rotor shaft and central pipe riser shall be of relatively large diameter and wall thickness and shall be made of high-strength and top-quality materials.

Electric motor 11 is fixed on chassis 12 which is roughly of barrel shape and is provided with enclosed bottom and an opening on the top. Chassis 12 can be made of steel in the center and of timber in the surface. Parts of its external surface can be wrapped with acoustic fabric and its internal wall can be fitted with acoustic device 14. Central pipe riser 13 is stretching through rotor shaft 6 which is of hollow pipe, without touching internal wall of rotor shaft. Central pipe riser 13 and rotor shaft 6 is coaxial. Lower end of the central pipe riser is fixed in the center of the bottom of chassis 12, while its upper end is firmly connected to the center of the top cover 17. External edge of top cover 17 is mounted with upper clamp anchor 20. The transparent outer garment which is of circular cylindrical surface is firmly fixed by upper clamp anchor 20 and lower clamp anchor 9 mounted on the upper plane on top of the chassis 12 under the fastening effect of central pipe riser 13. In this way, the transparent outer garment can be fastened firmly. Internal surface of outer garment 5 is coated with semitransparent films which can conceal internal fittings when the system is not at work. When necessary, top cover 17 can be fitted with semiconductor refrigerating installations 18 which can cool down display units. Electric power line 15 in the refrigerating device is stretching via central pipe riser 13 to the bottom of chassis 12 and then connected to external power supply (not shown in figures). Multiple adjustable footings 16 are mounted beneath the bottom of chassis 12. On the upper plane on top of chassis 12 are a number of level instruments 21 which are in the same plane and are vertically arranged to one another. In this way, it is ensured that when installed on different ground, rotor shaft and display units can be adjusted to be perpendicular to the horizontal plane. It is preferred to be such that among the level instruments 21 there are two vertically mounted level instruments which are connected to a motor starter (e.g. relay) in the driving devices, so that the motor starter can start driving device only when level parameters of these two level instruments conform to the requirements for technical indexes. To ensure normal operation of the system, it is recommended to mount a rubber sucker on footing 16, or fix the system on the ground with holding down bolts.

After the system is started, all display units will be driven by the electric motor and begin to rotate (It is advisable to play background music to conceal slight noise of the running electric motor). The display is put into operation when the units are rotating steadily at 6 circles per second (Background music can be stopped by the time). Then every observer around the system can view perfectly displayed pictures which are facing him squarely all the way. This system can conform to the audiovisual indexes and technical requirements for large-scale public places with large quantities of audience and bright background.

The above implemented example is merely one of the numerous examples with respect to this invention. It is available for common technical personnel in this field to suppose other examples in line with the conception of this invention and in combination with actual applications. For instance, this instruction is given on this invention on the basis of a system with four displays. However, it is known to technical personnel in this field that this invention can be adopted in systems with two, three, or more displays. Moreover, electric motor is used as driving source in the favorably implemented example as described above, yet it is know that other applicable driving devices such as explosive motor are applicable to this invention. Accordingly, application scope of this invention shall not be limited to the detailed structures described in this instruction. On the contrary, reasonable limitation shall be given by the attached right-claiming document.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

The invention claimed is:

1. An omni-directional display system comprising: a chassis;

a rotating display part comprising a rotary base plate and at least two displays affixed thereto for rotation as a unit with the rotary base plate, each said display defining a plane extending perpendicular from the rotary base plate and being provided with a blankoff device in front of the plane; and a vertical rotary driving device fitted on the chassis to rotate base plate along with the at least two displays therewith, wherein said vertical rotary driving device is connected to said rotating display part which together with the at least two displays will rotate around a vertical axis and thus realize omni-directional display when driven by said vertical rotary driving device, wherein said at least two displays are distributed around the vertical axis; wherein said at least two displays includes four displays, each of said four displays being affixed to the rotary base plate, said four displays extending perpendicular from the rotary base plate and being arranged in a square configuration, wherein the system further comprises a transparent cylindrical hull fixed to the rotary base plate for rotation with the four displays and the rotating base plate, said cylindrical hull surrounding the square configuration of the four displays.

2. The system, as recited in claim 1, wherein each said display is fitted with a display plane which is of a common shape and dimension.

3. The system, as recited in claim 1, wherein said at least two displays are symmetrically distributed around the vertical axis.

4. The system, as recited in claim 1, further comprising a transparent guard board mounted between each display and its blankoff device.

5. The system, as recited in claim 1, wherein said rotating display part further comprises an upper rotating cover horizontally mounted with the rotary base plate, and the generally cylindrical wind-resistant hull is fitted between the rotary base plate and the upper rotating cover, wherein the rotary base plate, upper rotating cover and the hull jointly form a relatively enclosed space, wherein each said display with its blankoff device is mounted in the enclosed space, with upper and lower ends of each display being respectively fixed on the upper rotating cover and the rotary base plate.

6. The system, as recited in claim 1, wherein the vertical rotary driving device is provided with a rotor shaft and the rotating display part is fixed on the rotor shaft for rotation therewith.

7. The system, as recited in claim 6, wherein the driving rotor shaft comprises a hollow pipe provided with an external surface having steps to position and fix the rotating display part.

8. The system, as recited in claim 7, further comprising a transparent outer garment which is mounted around the rotating display part and fixed on the chassis.

9. The system, as recited in claim 8, wherein the internal surface of the outer garment is coated with at least one semi-transparent film.

10. The system, as recited in claim 8, further comprising a top cover mounted on top of the outer garment which is fixed between the top cover and the chassis, wherein the top cover, outer garment and chassis jointly form a relatively enclosed space.

11. The system, as recited in claim 10, further comprising a semiconductor refrigerating installation fitted on the top cover to cool down the displays.

12. The system, as recited in claim 10, further comprising a central pipe riser extending through the hollow pipe, without touching its internal wall, wherein the central pipe riser and the rotor shaft are coaxial, wherein the lower end of the central pipe riser is fixed on the chassis, while its upper end is firmly fixed to the center of the top cover, whereby the outer garment is firmly clamped between the top cover and the chassis.

13. The system, as recited in claim 2, wherein each said display is rotationally-symmetrically distributed around the vertical axis, and the system further comprising a transparent guard board mounted between each display and its blankoff device;

wherein said rotating display part further comprises an upper rotating cover horizontally mounted with the rotary base plate, and the generally cylindrical wind-resistant hull is fitted between the rotary base plate and the upper rotating cover, wherein the rotary base plate, upper rotating cover and the hull jointly form a relatively enclosed space, wherein each said display with its associated blankoff device is mounted in the enclosed space, with its upper and lower ends being respectively fixed on the upper rotating cover and the rotary base plate; wherein the vertical rotary driving device is provided with a rotor shaft and the rotating display part is fixed on the rotor shaft for rotation therewith.

14. The system, as recited in claim 13, wherein the rotor shaft comprises a hollow pipe defining an external surface provided with steps to position and fix the rotating display part.

15. The system, as recited in claim 14, further comprising a transparent outer garment which is mounted around the rotating display part and is fixed on the chassis.

16. The system, as recited in claim 15, wherein an internal surface of the outer garment is coated with at least one semi-transparent film.

17. The system, as recited in claim 16, further comprising at least one semiconductor refrigerating installation fitted on the top cover to cool down the displays, wherein a central pipe riser extends through the rotor shaft, without touching its internal wall, wherein the central pipe riser and the rotor shaft are coaxial, wherein the lower end of the central pipe riser is fixed on the chassis, while its upper end is firmly fixed to the center of a top cover, whereby the outer garment is firmly clamped between the top cover and the chassis.

18. The system, as recited in claim 10, wherein each said display is generally rectangular.

19. The system as recited in claim 1, further comprising a cylindrical member fixed to the chassis and surrounding the cylindrical hull such that the four displays, cylindrical hull and rotary base plate are rotatable relative to the fixed cylindrical member.

20. The system as recited in claim 1, wherein each said display extends parallel to and is offset from the vertical axis.

* * * * *